US005595794A

United States Patent [19]

Cesar

[11] Patent Number: 5,595,794

[45] Date of Patent: Jan. 21, 1997

[54] ARCHIVAL PHOTOPRINT LAMINATE

[76] Inventor: Claudio Cesar, 45 Crystal Springs Rd., San Mateo, Calif. 94402

[21] Appl. No.: 439,460

[22] Filed: May 11, 1995

[51] Int. Cl.[6] ..... G09F 7/12

[52] U.S. Cl. ..... 428/13; 428/46; 428/423.1

[58] Field of Search ..... 428/13, 423.1, 428/46

[56] References Cited

U.S. PATENT DOCUMENTS

| | | | |
|---|---|---|---|
| 4,046,457 | 9/1977 | Land et al. | 428/333 X |
| 4,204,350 | 5/1980 | Brenner | 428/13 X |
| 4,378,392 | 3/1983 | Segel | 428/40 X |
| 4,768,811 | 9/1988 | Oshikoshi et al. | 283/82 |
| 4,790,088 | 12/1988 | Morvant | 428/13 X |
| 4,968,553 | 11/1990 | Cesar | 428/423.1 X |

OTHER PUBLICATIONS

Henry Wilhelm; *The Performance and Care of Color Photographs: Traditional and Digital Color Prints, Color Negatives, Slides, and Motion Pictures;* 1993; Chapter 1, pp. 20–24 and 28–31; Chapter 4, pp. 145–162.

Ilford Company; *Technical Service Information* Feb. 1987; pp. 1–27.

*Primary Examiner*—Henry F. Epstein

*Attorney, Agent, or Firm*—Gregory J. Gore

[57] ABSTRACT

An archival photoprint laminate process employs a dye-bleach developed transparent print laminated on both sides using a polyurethane bonding material which includes UV inhibitors, and then fusing those three layers between opposing sheets of glass in a standard type heat-laminating process. An aliphatic polyether urethane extruded sheet is employed as the bonding material. The print is developed on ILFORD CC.F7 transparent display film by the Ilford CIBACHROME II process.

4 Claims, 2 Drawing Sheets

FIG. 3

EXPOSURE RESULT TABLE

| STRUCTURE TESTED LAMINATE MATERIAL | GREY 1.0 FILTER | | | | |
|---|---|---|---|---|---|
| | PHOTOGRAPHIC MATERIAL | EXPOSURE TIME (KJ/cm2) | % CHANGE IN BLUE | % CHANGE IN RED | % CHANGE IN GREEN |
| CESAR COLOR GLASS AND PE-399 | CC. F7 | 240 | 0% | -1% | -2% |
| PLEXIGLASS DIASEC | CC. F7 | 240 | -4% | -8% | -5% |
| | FUJICLEAR SFA | 240 | -14% | -30% | -17% |
| | ICRA. F7 | 240 | -14% | -38% | -18% |
| | DURACLEAR KODAK | 240 | -19% | -41% | -23% |
| MACTAC UV-FILM PG 7036 | CC. F7 | 240 | -4% | -8% | -8% |
| | FUJICLEAR SFA | 240 | -11% | -27% | -11% |
| | ICRA. F7 | 240 | -10% | -37% | -13% |
| | DURACLEAR KODAK | 240 | -16% | -22% | -19% |

ARCHIVAL PHOTOPRINT LAMINATE

FIELD OF THE INVENTION

This invention relates to the extended life preservation of photographs by using coatings and laminated transparent materials. More specifically, it relates to bonding photographic materials to glass.

BACKGROUND OF THE INVENTION AND DESCRIPTION OF PRIOR ART

As the field of fine color photography becomes more mature, a greater appreciation for the loss of print quality due to environmental degradation through aging has been realized. Various print coatings and laminating materials have been tried in an attempt to provide protection which is effective in extending the life of photographic prints. The fading of photographic prints is a continuously progressive process, principally caused by ultraviolet radiation, cycling relative humidity, high temperature, atmospheric pollution, and oxidation. Print degradation is significant in the two most common processing systems, namely, dye bleaching and chromogenic development. Photographic degradation is particularly acute with chromogenic development.

Various specific solutions to the problems of preserving photographic prints have been developed to achieve a very long life or "archival" storage of photographs. These include the use of print lacquers, plastic laminates, spray coatings, and UV-absorbing plastic filters. In his book, entitled "*The Permanence and Care of Color Photographs: Traditional and Digital Color Prints, Color Negatives, Slides, and Motion Pictures*" (Preservation Publishing Co., Grinnell, Iowa, 1993), Henry Wilhelm describes the effects of each of these preservation methods in great detail. As this reference explains, many of the commercially-accepted techniques for extending the life of photographic prints may actually reduce the light stability of the photographs, rather than extending it.

Many of the large photographic companies have spent great effort testing materials and methods for preserving their products. One such study was published by the Ilford Company of Fribourg, Switzerland, in July of 1987, entitled "*Technical Service Information* 2–87". This publication describes the various methods for best preserving their products. These tests indicate that holding color photographs between glass plates was not effective in preserving the light stability and that the most effective method was embedding photographic prints in a liquid plastic, which is then cross-linked by UV or moderate heat to form a solid sheet. The embedding materials tested were SPECTRALITE and DUROLITE polyester resins. Embedding is not a readily available technique since special equipment and skill are required and it is only normally performed by specialized firms. This publication also confirms that without protection, typical photographic prints, such as the Ilford CIBACHROME II prints, only have a life expectancy in low light, indoor conditions of from 10–15 years.

While not applicable to photography, it is also known to laminate colored inks printed on a polyurethane interlayer between glass plates, the polyurethane being both the printing substrate and the bonding material. This method of creating an architectural graphic glass structure is described by the applicant in his previously issued U.S. Pat. No. 4,968,553. It is also commonly known to heat-seal portrait photographs between opposing sheets of plastic, such as polyvinyl chloride (PVC). This process is used for making personal identification cards, however, it is unacceptable because the PVC continues to harden as it ages and often cracks and yellows. Such a process is disclosed in U.S. Pat. No. 4,768,811 issued to Oshikoshi et al.

U.S. Pat. No. 4,378,392, issued to Segel, shows a photographic preservation laminate composed of a transparent film of ultraviolet-stabilized polyurethane terephthalate or ultraviolet-stabilized acrylonitrile and a transparent silicone or acrylic adhesive bonded to the film, the laminate being adapted to be bonded to the image surface of the photograph by the adhesive. This reference also discloses that to provide even greater protection, an additional layer of transparent fluorocarbon polymer may be bonded to the other laminated materials with a silicone or acrylic adhesive.

There is therefore a need in the art for a method of obtaining archival preservation of photographic prints which is effective, readily available, and economical.

SUMMARY OF THE INVENTION

In order to meet the above-described need in the photographic arts, the applicant has discovered a unique combination of photographic and laminating materials which have shown surprising and unexpected results in achieving the preservation of photographic prints. The applicant has found that by using a dye-bleaching transparent print, laminated on both sides, using a polyurethane bonding material which includes UV inhibitors, and then fusing those three layers between opposing sheets of glass in a standard type heat-laminating process, that superior results can be achieved. While it has been known that glass is an excellent material for preventing moisture and air migration, it has been shown in the art to be detrimental to photographic prints when used alone. Similarly, an aliphatic polyether urethane is also known not to possess the optical quality of other preferred photographic laminates, nor is it particularly effective as a moisture or gas barrier. The applicant was the first to discover by using the combination of polyurethane as the bonding element and glass as an additional outer laminated structure, that photographic prints of acceptable optical quality may be preserved for an extraordinarily long time without degradation. The use of a dye-bleaching development color film, rather than a chromogenic film, also adds to the permanence of the laminated photoprint.

More specifically, the applicant has invented an archival photoprint laminate, comprising: a photographic print processed using a dye-bleaching development system; a polyurethane bonding material applied to opposing sides of the developed print; and two glass plates applied to the polyurethane bonding material, one on each opposing side, thus creating a 5-piece bonded laminate structure. The polyurethane is an aliphatic polyether urethane which contains UV inhibitors. The developed print is ILFORD CC.F7 transparent display film developed by the Ilford CIBACHROME II development process.

It is therefore an object of the present invention to create a photographic print preservation laminate and laminating process which is readily available and economical.

It is a further object of the present invention to create the archival preservation of photographic prints which provides resistance to mechanical damage, as well as resistance to adverse environmental effects of light and moisture.

Other objects, advantages and novel features of the invention will become apparent from the following detailed description of the invention when considered in conjunction with the accompanying drawings.

BRIEF DESCRIPTION OF THE DRAWINGS

FIG. 3 is a table with the results of the present invention compared with the prior art.

DESCRIPTION OF THE PREFERRED EMBODIMENT

Figure 1:
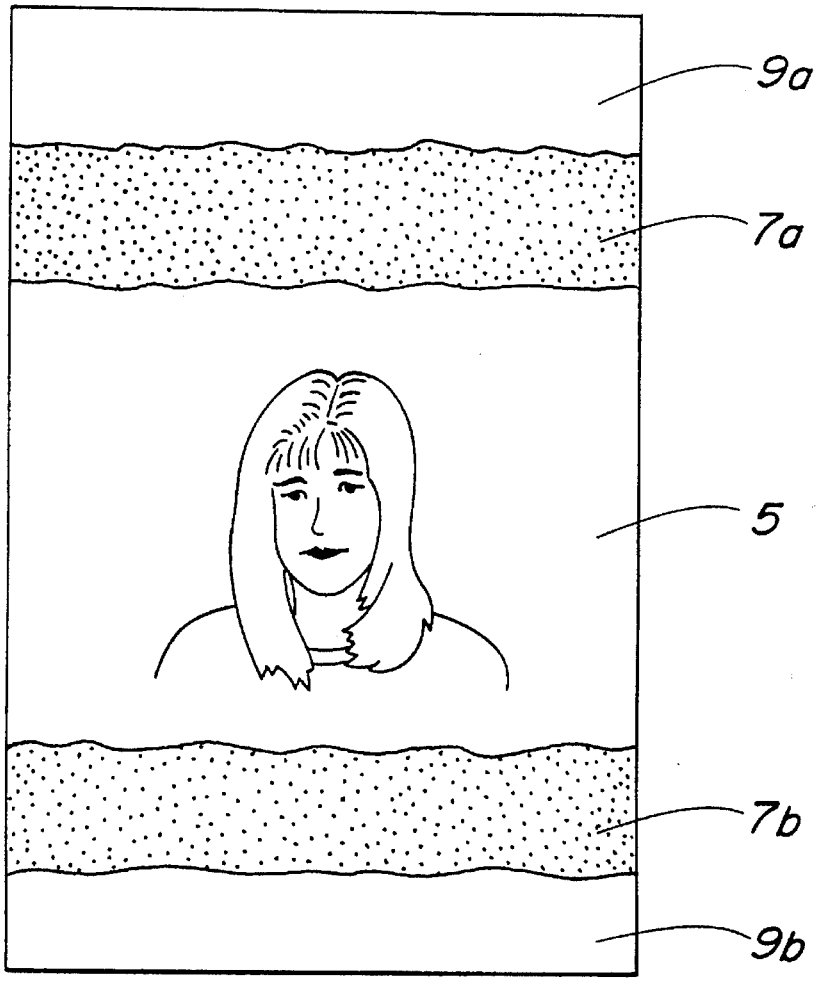
FIG. 1 is a partially cutaway front view of the present invention.
Figure 2:
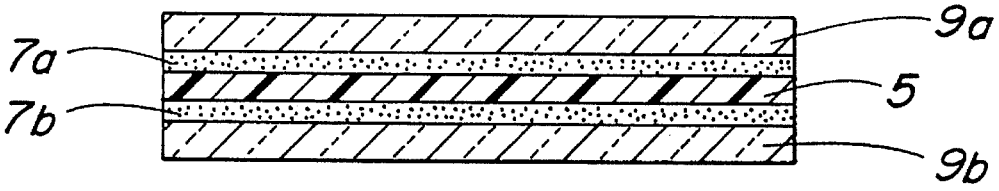
FIG. 2 is a bottom view.

Referring to FIGS. 1 and 2, the present invention relates to archival quality color photoprints utilizing the laminated structure of a dye-bleaching developed film 5 adhered between opposing glass plates 9*a* and 9*b* using a polyurethane bonding material 7*a* and 7*b* on opposing sides of the film. The materials specifically used are Ilford CC.F7 photographic transparent display film processed by the Ilford CIBACHROME II development process; Morton International PE-399 polyurethane; and ordinary plate glass. The polyurethane is in the form of an extruded sheet interlayer which contains UV inhibitors. These elements are then laminated under heat and pressure according to the standard safety glass laminating process. The result is a mechanically-durable and environmentally stable photoprint which has acceptable optical qualities and which in tests has shown superior resistance to degradation when compared to other well-known photoprint preservation systems.

The table shown in FIG. 3 compares the present invention with Diasec PLEXIGLAS and MATAC UV film, the latter two systems being utilized with four different types of photographic materials; namely, ILFORD CC.F7 transparent display film (dye-bleach); FUJI CLEAR SFA film (chromogenic); ILFORD ICRA.F-7 film (chromogenic); and KODAK DURACLEAR film (chromogenic). As this table indicates, all the chromogenic materials have unacceptable light stability behind the PLEXIGLAS and MATAC film, whereas the CC.F7 material laminated according to the present invention has excellent light stability and remains almost unchanged. The specific reasons for the excellent performance of the present invention is not entirely known, however, it is speculated that the prior art materials may leak out some chemical products which destabilize the photoprint dyes. These results are both surprising and unexpected, and the particular types of materials used in the preferred embodiment have shown to be critical to the performance of the present invention.

The present invention not only provides a system for the archival storage of color photography, but may also be used as a graphic structural element in both building interior and exterior architectural applications, such as signage, wall partition systems, graphic windows, and the like. Other applications and uses of the present invention are unlimited and the scope of the invention should only be determined by the following claims and their legal equivalents.

What is claimed is:

1. An archival photoprint laminate, comprising:

a photographic print;

a polyurethane bonding material applied to opposing sides of said print; and two glass plates fused to said polyurethane bonding material, one on each of said opposing sides, thus creating a 5-piece bonded laminate structure.

2. The laminate of claim 1, wherein said polyurethane is an aliphatic polyether urethane which contains UV inhibitors.

3. The laminate of claim 2, wherein said photographic print is transparent.

4. An archival photoprint laminate, comprising:

a transparent photographic print;

two sheets of polyurethane bonding material fused to opposite sides of said print one on each side; and two glass plates fused to said bonding material, one on each of said opposing sides, thus providing a permanently bonded five-piece laminate structure.

* * * * *